US005208987A

United States Patent [19]

Christen

[11] Patent Number: 5,208,987

[45] Date of Patent: May 11, 1993

[54] MARKING DEVICE WITH VIBRATING YIELDABLE WRITING TIP

[75] Inventor: Richard P. Christen, Sandy, Oreg.

[73] Assignee: Hart Enterprises, Inc., Vancouver, Wash.

[21] Appl. No.: 881,873

[22] Filed: May 12, 1992

[51] Int. Cl.[5] ..... B43K 19/00; B43K 21/00; B43L 13/00

[52] U.S. Cl. ..... 33/18.1; 33/18.2; 33/27.11; 346/141; 346/139 C

[58] Field of Search ..... 33/18.1, 18.2, 27.01, 33/27.11, 32.1, 34, 37; 346/139 C, 141

[56] References Cited

U.S. PATENT DOCUMENTS

| | | | |
|---|---|---|---|
| 485,767 | 11/1892 | Lewis | 346/141 |
| 2,029,771 | 2/1936 | Gray | 33/18.1 |
| 2,249,906 | 7/1941 | Longoria . | |
| 2,467,083 | 4/1949 | Francis, Jr. | 33/18.1 |
| 2,744,329 | 5/1956 | Way et al. | 33/18.1 |
| 3,158,936 | 12/1964 | Virta . | |
| 3,297,003 | 1/1967 | Benson | 33/27.11 |
| 3,390,460 | 7/1968 | Brown et al. | 33/18.1 |
| 3,779,652 | 12/1973 | Kunitoku . | |
| 3,861,077 | 1/1975 | Lindquist . | |
| 3,997,972 | 12/1976 | Jaunarajs . | |
| 4,037,283 | 7/1977 | Moisiuk . | |
| 4,091,393 | 5/1978 | Masuyama et al. | 33/18.1 |
| 4,211,012 | 7/1980 | Alles et al. . | |
| 4,299,506 | 11/1981 | Hashimoto . | |
| 4,426,783 | 1/1984 | Gerber et al. | 33/18.1 |
| 4,542,589 | 9/1985 | Yamamoto | 33/18.1 |
| 4,599,799 | 7/1986 | Lopez | 33/18.2 |
| 4,862,592 | 9/1989 | Richard et al. | 33/18.1 |

FOREIGN PATENT DOCUMENTS

| | | | |
|---|---|---|---|
| 545861 | 7/1956 | Italy | 33/18.1 |

*Primary Examiner*—William A. Cuchlinski, Jr.
*Assistant Examiner*—C. W. Fulton
*Attorney, Agent, or Firm*—Kolisch, Hartwell, Dickinson, McCormack & Heuser

[57] ABSTRACT

A marking device which includes a hand-held housing and electrically powered means for vibrating the housing. An ink cylinder having a writing tip at its end is slidably supported within a cartridge casing, and a spring biases the cylinder outwardly on the casing. The casing is supported on the housing of the marking device.

17 Claims, 1 Drawing Sheet

MARKING DEVICE WITH VIBRATING YIELDABLE WRITING TIP

BACKGROUND AND SUMMARY OF THE INVENTION

This invention relates to a marking device, and more particularly to a marking device of the type which includes a housing supporting a writing instrumentality or tip at one end, and means for imparting a rapid vibratory motion to the housing, with this motion imparted from the housing to the writing instrumentality. When the marking device is used in the drawing of a line, the vibratory or oscillatory movement of the instrumentality produces a back-and-forth looping character to the line produced. The marking device is useful in the field of toys and games, since it is readily used to produce amusing and interesting drawings and designs. The device also has utility in making decorative markings, and in other applications where unique visual effects are desired.

A general object of the invention is to provide an improved marking device of the above-described character,i.e. a device where an oscillatory or vibratory motion is imparted to the writing tip in the device, which is easier to use than prior known devices. A related object is to provide such a device which has a construction inhibiting any tendency in the writing tip to be thrown off a writing surface at certain stages of its oscillatory motion.

More specifically, the invention features and includes as an object the provision of a yieldable resilient means in the mounting of the writing tip, which accommodates movement in the tip which counteracts movement produced by a powered means vibrating the writing tip.

Another object is to provide a marking device with a writing tip which is oscillated by rapidly and recurrently displacing the tip from various positions disposed laterally about a center position, the marking device further including resilient and yieldable means mounting the tip counteracting forces produced by reason of such displacement.

In a preferred embodiment, and as another object, the invention contemplates a construction wherein the tip, and the resilient and yieldable means mounting it, are part of a cartridge construction in the marking device. The cartridge construction permits removal of a cartridge and replacement of the cartridge with another one, to enable the user, for instance, to make changes in the type of markings made by the device.

BRIEF DESCRIPTION OF THE DRAWINGS

These and other objects and advantages are attained by the invention, which is described hereinbelow in conjunction with the accompanying drawings, wherein.

FIG. is a perspective view illustrating a marking device constructed pursuant to the invention.

DETAILED DESCRIPTION OF A PREFERRED EMBODIMENT

Figure 1:
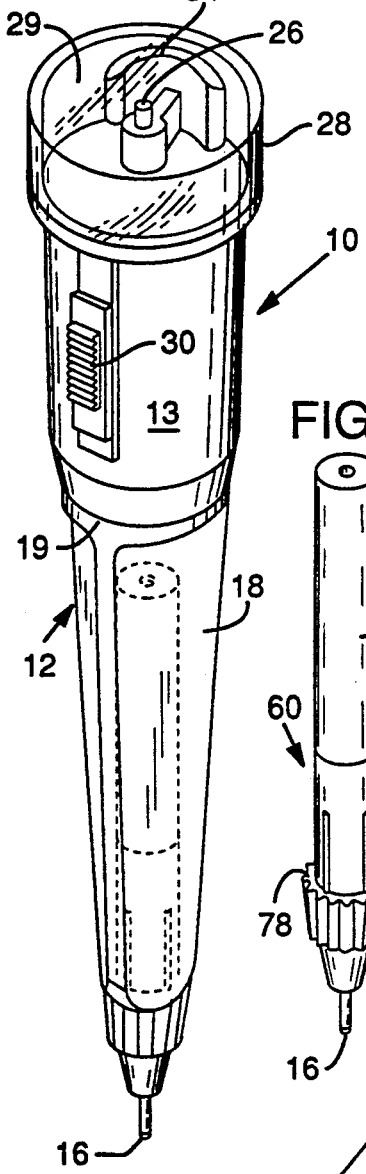

Referring now to the drawings, the marking device illustrated is a hand-held device generally indicated at 10, which includes an elongate hand-held housing 12, and a writing tip or instrumentality 16 held in a position disposed beyond one end of the housing. Housing 12 includes a substantially cylindrical upper section 13, and a tapered lower section shown at 18. The sections are detachably joined together, and when detached separate at line 19. Separation of the sections provides access to the interior of the housing.

Housing section 13 mounts within it an electric motor (not shown) having an output shaft 26. Supported within the lower section of the housing, and accessible by removing the upper section from the lower section, is a conventional battery (not shown). Suitable circuitry, including switch 30, electrically connects the battery with the motor, with energizing and deenergizing of the motor controlled by the switch.

A transparent dome 28 mounted on the upper end of housing section 13 bounds a hollow chamber 29.

A weighted eccentric member 34 within chamber 29 is secured to the end of shaft 26. With energizing of the motor electric and turning of shaft 26, the eccentric member is moved in an orbital path about the axis of the housing. This produces a rapid reactionary orbital movement in the upper portion of the housing, referred to herein as a type of vibratory or oscillatory motion.

With the marking device held between the thumb and fingers of a hand, in the manner of gripping the usual pencil, the thumb and fingers grip the housing at a region located intermediate the ends of the housing. With the motor operating, an orbital oscillatory motion is produced in the extreme upper end of the housing by the eccentric member described. The housing universally pivots about the support provided by the fingers. This results in a reactive oscillatory or vibratory motion in the opposite end of the housing, and this motion is transmitted to the writing tip.

Marking devices having a housing and a power-operated, eccentrically mounted means producing, when rotated, an orbital type, vibratory motion, are known. This invention is directed to certain improvements in marking devices of this description, which render the marking device more easily used, more comfortable to use, and more reliable in the nature of the line produced with operation of the device.

Figure 5:
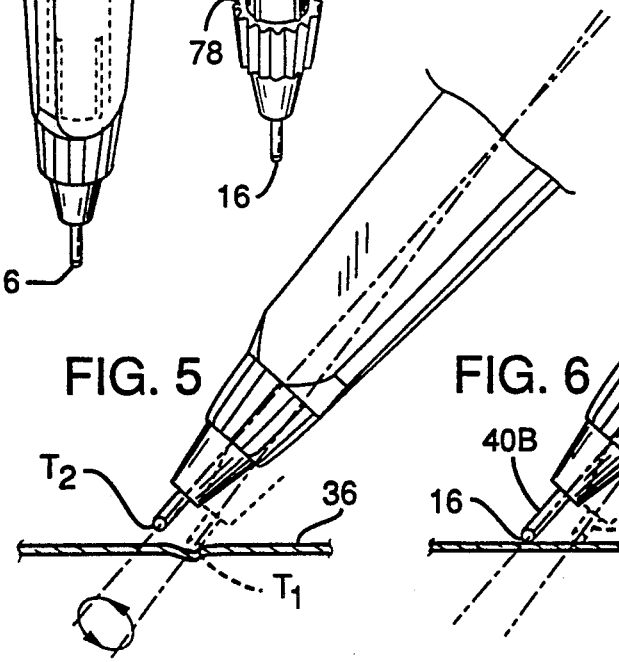
FIGS. 5 and 6 are enlarged simplified drawings illustrating the effect of including a yieldable and resilient mounting for the writing tip, as contemplated herein.

Further explaining, a natural manner of holding the device during use would be to hold the device with the device at an acute angle with respect to the plane of the surface being written on. Assuming that the marking device is held in an inclined position by the hand, and assuming that no movement is imparted to the tip other than that caused by the rotating eccentric, then the tip will tend to rotate in a tight orbit, with the tip moving from a low point where the eccentric action has caused the housing to swing to its most upright position, to a high point for the tip where the eccentric has caused the housing to swing to its most inclined position. In FIG. 5, which for clarity reasons is an exaggerated drawing of tip positions, these positions for the tip are indicated at T1 and T2. The sheet being written on is shown at 36.

With the instrument or device held by the fingers in a position not too inclined from perpendicular, and because the usual paper is somewhat compressible and resilient, and because the fingers normally provide a slight dampening action as the device is held, the tip will continue to inscribe a line against the paper in all of the positions caused by the oscillatory movement produced by the eccentric. However, it should be obvious that with smoother, harder papers, and with the writing device held at a more sharply inclined position with respect to the plane of the paper, there is a tendency as orbital movement is produced for the writing tip to contact and press hard against the paper at the low point T1, but to move out of paper contact at point T2. This results in uneven darkness to the line produced or, in more severe conditions, an interrupted line being produced. Further, the hand is subjected to a sharp vibratory motion caused by the tendency of the writing tip periodically to tend to force the hand away from the plane of the paper as the tip moves into the position of T2.

This invention takes care of the problems above discussed by including flexible resilient means in the mounting of the tip accommodating movement in the tip counteracting movement produced by the powered rotation of the eccentric member.

Figure 2:
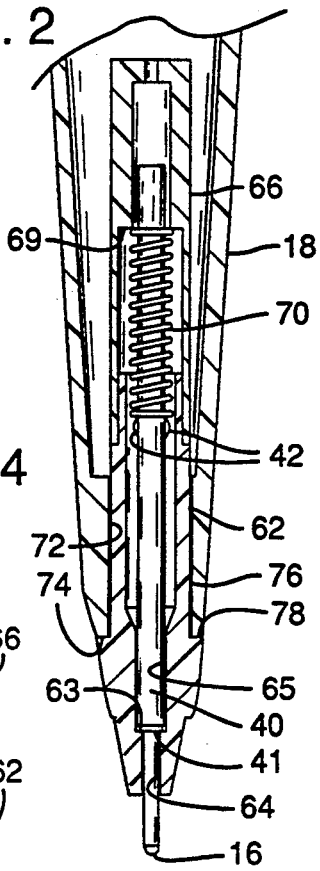
FIG. 2 is a cross-sectional view of a lower portion of the marking device.
Figure 3:
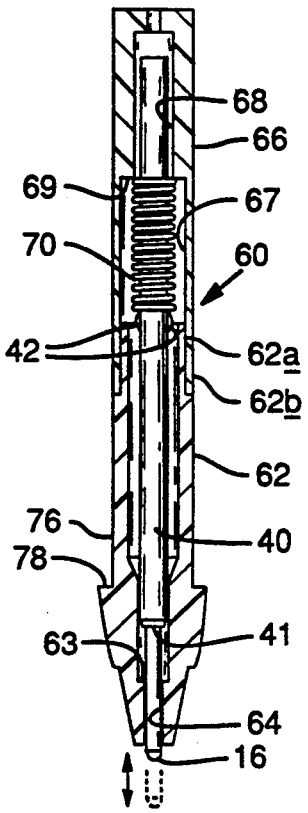
FIG. 3 is a cross-sectional view of a cartridge in the marking device.
Figure 4:
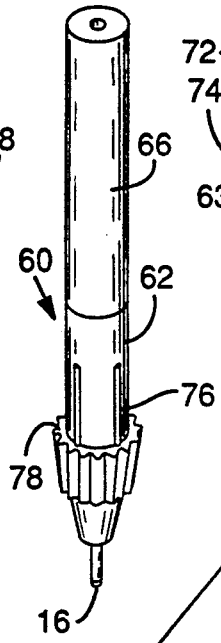
FIG. 4 is a perspective view of the cartridge.

Further explaining, and referring to FIGS. 2, 3, and 4, writing tip 16, in the form of the invention shown, is a small ball rotatably supported at the end of an elongate ink cylinder 40. Ink cylinder 40 is formed to have, at regions between its ends a shoulder 41, and a pair of laterally protruding ears 42.

A cartridge casing is shown at 60. The cartridge casing includes a lower section 62, having bores 64, 65 extending therealong. Where bore 64 meets bore 65, a ledge 63 is formed.

Snugly fitted onto the lower section is an upper section 66 of the cartridge casing. The bottom of section 66 snugly encompasses stem portion 62*a* of the lower section, and the base of section 66 comes up against ledge 62*b*.

Upper section 66 has an axial passage 67 extending therealong meeting with an axial passage 68 of somewhat reduced diameter at the location of a shoulder 69.

Ink cylinder 40 is mounted in the cartridge casing with the lower part of the cylinder extending through bores 64, 65, and shoulder 41 against ledge 63. The ink cylinder continues from bores 64, 65 through bores 67, 68.

A biasing means or coil spring is shown at 70. Such encircles the upper portion of the ink cylinder. One end of spring 70 abuts ears 42. The opposite end of the coil spring abuts shoulder 69. As positioned, the spring yieldably resists movement of the ink cylinder in an axial direction upwardly in FIGS. 2 and 3.

The cartridge assembly just described, comprising the casing, the ink cylinder, and the spring, is removably mounted on the lower end of housing section 18. Specifically, a passage 72 extends inwardly from the lower end of housing section 18, and this passage joins with a shoulder surface 74. Cartridge casing 60 has a grip surface region 76 joining with a shelf surface 78.

The cartridge assembly is removably mounted within passage 72 by inserting the upper end of the cartridge casing into passage 72, and moving the casing until shelf surface 78 abuts shoulder surface 74. Grip surface 76 establishes frictional contact within passage 72. With the cartridge construction described, it is a relatively easy matter to change the writing tip, and, for instance, the color of ink used in the writing, when desired.

Figure 6:
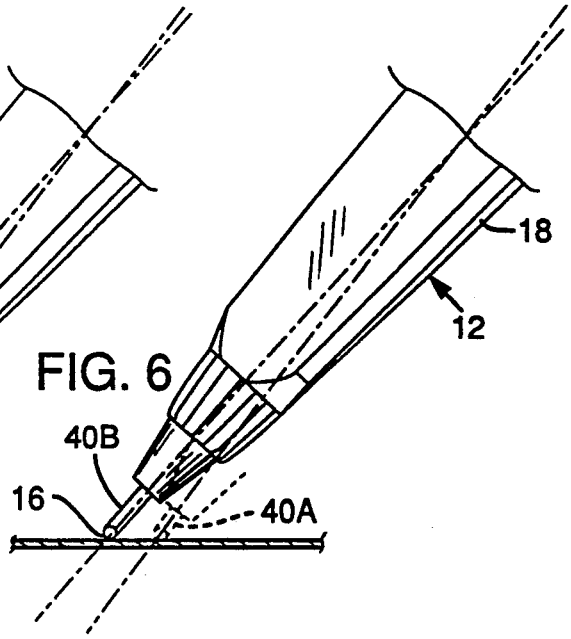

Explaining the action of the coil spring and the yieldable resilience it provides, as already explained, during use, the marking device may ordinarily be held by the hand at an inclined angle with respect to the writing surface. With the device held with the fingers so that the tip is contacting the paper or other medium which makes up the writing surface, and with the motor running to produce orbital vibrations by reason of rotation of the eccentric member, the ink cylinder is moved in a small orbit, which would swing the writing tip at the end of the cylinder between high and low points as illustrated in FIG. 6, but for the yieldable resilience provided by the coil spring. With the spring, however, the writing tip tends to be maintained in contact with the writing surface. This is because with the ink cylinder swung to its most upright position, as indicated by the position 40A in FIG. 6, the ink cylinder can move axially inwardly on its mounting with slight compression of the spring. With continued orbital movement of the ink cylinder to reach the position shown at 40B (the most inclined position of the cylinder), the cylinder extends in its mounting under the urging of coil spring 70, maintaining writing tip 16 in contact with the paper or writing surface. The result is the production of a line which tends to extend continuously and without inadvertent interruptions. Additionally, it should be noted there is far less abrupt vibrations imparted to the hand of the user. This is because the fingers are not repeatedly caused by holding the instrument to move up-and-down with respect to the writing surface.

While an embodiment of the invention has been described, it should be obvious that variations and modifications are possible.

It is claimed and desired to secure by Letters Patent:

1. A marking device for marking a writing surface comprising:

an elongate housing, a writing tip and mounting means mounting the tip on the housing and in a position located beyond one end of the housing, said mounting means including resilient yieldable means biasing the tip relative to the housing, electrically powered means for producing oscillatory motion in the housing with such movement transmitted by the housing to the tip, said resilient yieldable means providing for continuous contact of the tip with the writing surface during oscillation of the tip in a plane perpendicular to the tip while the marking device is held at an acute angle with the writing surface.

2. The marking device of claim 1, wherein the resilient yieldable means accommodates movement of the tip in a path extending along the axis of the housing.

3. The marking device of claim 1, wherein said electrically powered means produces oscillatory motion in a direction extending laterally of the axis of the housing.

4. The marking device of claim wherein the electrically powered means produces oscillatory motion in a direction extending laterally of the housing, and wherein the resilient yieldable means accommodates movement of the tip in a path extending along the axis of the housing.

5. The marking device of claim 1, wherein said writing tip is a ball, and the mounting means includes an elongate ink cylinder having the ball at the end thereof and a cartridge casing housing said ink cylinder, and said resilient and yieldable means comprises a spring interposed between the ink cylinder and the cartridge casing.

6. The marking device of claim 5, wherein said housing has casing-receiving means detachably receiving said cartridge casing, and the cartridge casing is removably mounted in said casing-receiving means.

7. The marking device of claim 6, wherein said casing-receiving means defines a path of movement for the cartridge casing which extends axially of the housing.

8. A marking device for marking a writing surface comprising:

a writing tip, an elongate cylinder mounting the writing tip with the tip at one end of the cylinder, a housing supporting the cylinder with the cylinder moveable in a path within the housing and with the tip disposed beyond one end of the housing, a spring engaging the cylinder biasing the cylinder to a position extending outwardly from the housing, and electrically powered means for producing oscillatory movement of the housing, said spring providing for continuous contact of the tip with the writing surface during oscillation of the tip in a plane perpendicular to the tip, while the marking device is held at an acute angle with the writing surface.

9. The marking device of claim 8, which further includes a cartridge casing, and a mounting for the cylinder within the cartridge casing, said mounting including means defining a path of travel for the cylinder within the casing, said spring being mounted in the cartridge casing and biasing the cylinder in said path, the cartridge casing being removably supported in said housing.

10. A marking device for marking a writing surface comprising:

a writing tip, an elongate cylinder mounting the writing tip with the tip at one end of the cylinder, a cartridge casing having means therewithin for mounting the cylinder with a path of travel defined for the cylinder relative to the casing, a spring mounted within the cartridge casing interposed between the casing and the cylinder and biasing the cylinder in a direction extending outwardly from the casing, an elongate housing, means in the housing defining a removably supported position for the cartridge casing within the housing with the casing when positioned holding the writing tip in a position disposed beyond one end of the housing, and electrically powered means mounted on the housing for producing the oscillatory motion of the housing with such motion imparted from the housing to said tip, said spring providing for continuous contact of the tip with the writing surface during oscillation of the tip in a plane perpendicular of the tip, while the marking device is held at an acute angle wit h writing surface.

11. A marking device for marking a writing surface comprising:

an elongate housing;

a writing tip;

a mount for mounting the tip on the housing in a position located beyond one end of the housing;

an electrically powered motor for producing a oscillatory motion in the housing with such movement transmitted by the housing to the tip; and a resilient element operably connected with said mount, said resilient element biasing the tip relative to the housing and accommodating movement of the tip counteracting movement produced by said motor, such that the tip continuously contacts the writing surface during oscillation of the tip in a plane perpendicular of the tip, while the marking device is held at an acute angle with the writing surface.

12. The marking device of claim 11, wherein the resilient element accommodates movement of the tip in a path extending along the axis of the housing.

13. The marking device of claim 11, wherein said motor produces oscillatory motion in a direction extending laterally of the axis of the housing.

14. The marking device of claim 11, wherein the electrically powered motor produces oscillatory motion in a direction extending laterally of the housing, and wherein the resilient element accommodates movement of the tip in a path extending along the axis of the housing.

15. The marking device of claim 11, wherein said writing tip is a ball, and the mount includes an elongate ink cylinder having the ball at the end thereof and a cartridge casing housing said ink cylinder, said resilient element comprises a spring interposed between the ink cylinder and the cartridge casing.

16. The marking device of claim 5, wherein said housing has a casing-receiving element detachably receiving said cartridge casing, and the cartridge casing is removable mounted in said casing-receiving element.

17. The marking device of claim 16, wherein said casing-receiving element defines a path of movement of the cartridge casing which extends axially of the housing.

* * * * *